US005586619A

United States Patent [19]

Young

[11] Patent Number: 5,586,619

[45] Date of Patent: Dec. 24, 1996

[54] LIFTING APPARATUS

[76] Inventor: Roland O. Young, R.R. #1, Box 138, Grand Forks, N. Dak. 58201

[21] Appl. No.: 344,886

[22] Filed: Nov. 25, 1994

[51] Int. Cl.[6] ..... B66F 9/06; B66F 9/08

[52] U.S. Cl. ..... 187/226; 187/253; 187/275

[58] Field of Search ..... 187/253, 226, 187/272, 275

[56] References Cited

U.S. PATENT DOCUMENTS

| | | | |
|---|---|---|---|
| 3,394,778 | 7/1968 | Brinton | 187/226 X |
| 3,541,928 | 11/1970 | Conwell et al. | 187/226 X |
| 3,854,699 | 12/1974 | Garnett | 187/226 X |
| 4,401,191 | 8/1983 | Bartow | 187/253 X |
| 4,889,038 | 12/1989 | Bentivoglio | 187/226 X |

*Primary Examiner*—William E. Terrell
*Assistant Examiner*—Dean A. Reichard
*Attorney, Agent, or Firm*—Robert E. Kleve

[57] ABSTRACT

The invention comprises a lifting apparatus having a mobile housing with three telescoping sleeves slidably mounted in one another and in said housing to slide upward in telescoping relation out of said housing. The housing has a hydraulic piston and cylinder mounted upright in the housing, with the piston fixed to the housing and the cylinder is hydraulically actuatable to telescope upward in the housing relative to the piston. Rollers are mounted to the top of the cylinder and the first two of the sleeves. A first chain has one end mounted below the roller on the cylinder and its other end mounted to the lower end of the first of the sleeves. A second chain is mounted to the housing below the roller on the first sleeve and its other end mounted on the other side of the roller to the lower end of the second sleeve. A third chain is mounted below the roller on the second sleeve on one side and below the roller to the lower end of the third chain on the other side, whereby the actuating cylinder causes the first chain to move upward and thereby the first sleeve to move upward, which causes the second chain to move the second sleeve upward, causing the third chain to move the third sleeve upward with each sleeve telescoping with respect to one another. The third sleeve is mounted with a lifting frame for lifting objects thereon during the telescoping action of the sleeves. A detachable power pack is mounted to the housing for powering the cylinder.

11 Claims, 4 Drawing Sheets

LIFTING APPARATUS

BACKGROUND OF THE INVENTION

This invention relates to lifting apparatus for lifting various objects. This invention is also related to my earlier co-pending patent application, Ser. No. 018,120, filed: Feb. 17, 1993, now U.S. Pat. No. 5,368,429, entitled: Panel Lift Apparatus.

It is an object of the invention to provide a novel lifting apparatus for lifting various objects having a plurality of telescoping chain driven sections for telescoping an object upward with a power driven means for powering the telescoping sections.

It is a further object of the invention to provide a novel lifting apparatus for power a pluraity of telescoping sections upward and which has a detachable power pack for powering the sections.

It is another object of the invention to provide a novel power driven telescoping apparatus.

Further objects and advantages of the invention will become apparent as the description proceeds and when taken in conjunction with the accompanying drawings wherein:

BRIEF DESCRIPTION OF PREFERRED EMBODIMENT

Briefly stated, the invention comprises a lifting apparatus having a mobile housing with three telescoping sleeves slidably mounted in one another and in said housing to slide upward in telescoping relation to telescope upward a drywall panel to an upper height for installation. The housing has a hydraulic piston and cylinder mounted therein, and chain connection between the sleeves and the cylinder, whereby upward movement of the cylinder relative to the piston in the housing acts through the chain connection to telescope the sleeves upward out of the housing, for telescoping the panel upward. A horizontal platform is detachably mounted to the housing carrying a power pack for powering the cylinder. The platform has a reservor thereon for holding hydraulic fluid and a pump for pumping fluid from the reservoir along a hose line from the platform to the cylinder in the housing to telescoping the cylinder hydraulically relative to the piston. The platform also has a battery for powering an electric motor, with the electric motor powering the pump. The platform and hose line have detachable connections between the housing and hose connection to the cylinder for detaching the platform and components from the housing.

Figure 2:
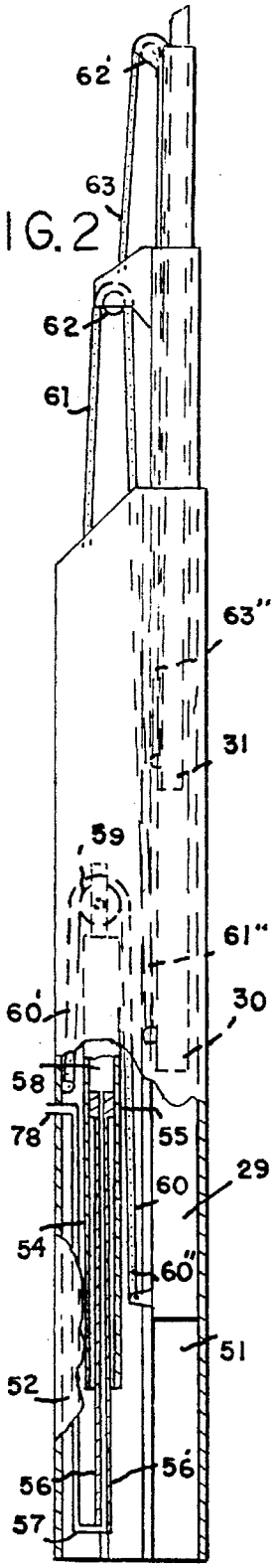
FIG. 2 is an enlarged side cutaway view of the housing and telescoping sections of the apparatus and the fluid actuated piston and cylinder mounted in the housing for powering chains to telscope the telescoping sections upward.
Figure 1:
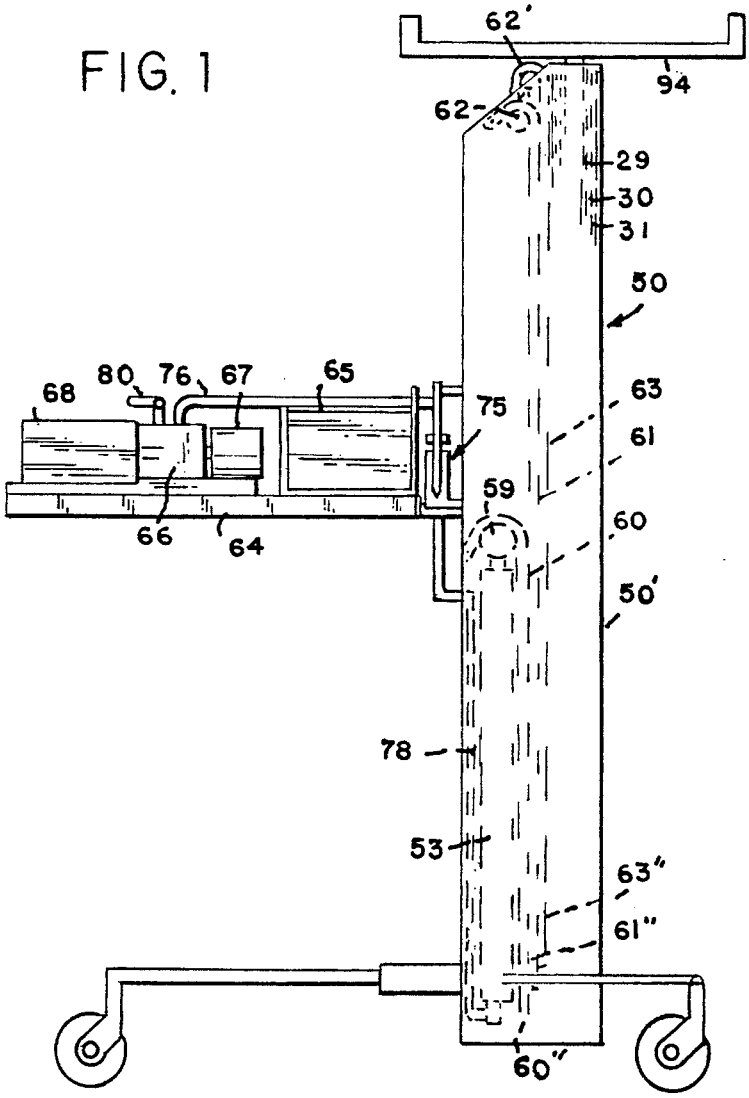
FIG. 1 is a side elevational view of the power operated chain driven telescoping apparatus for lifting objects such as dry wall panels.
Figure 4:
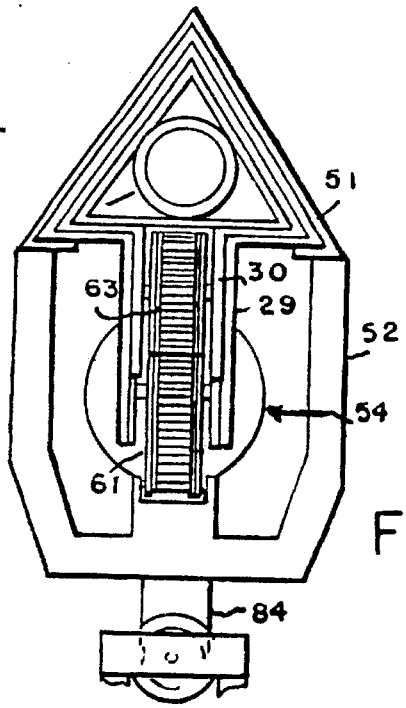
FIG. 4 is an enlarged fragmentary top view of the housing and telescoping sections and the hydraulic cylinder of the apparatus.
Figure 3:
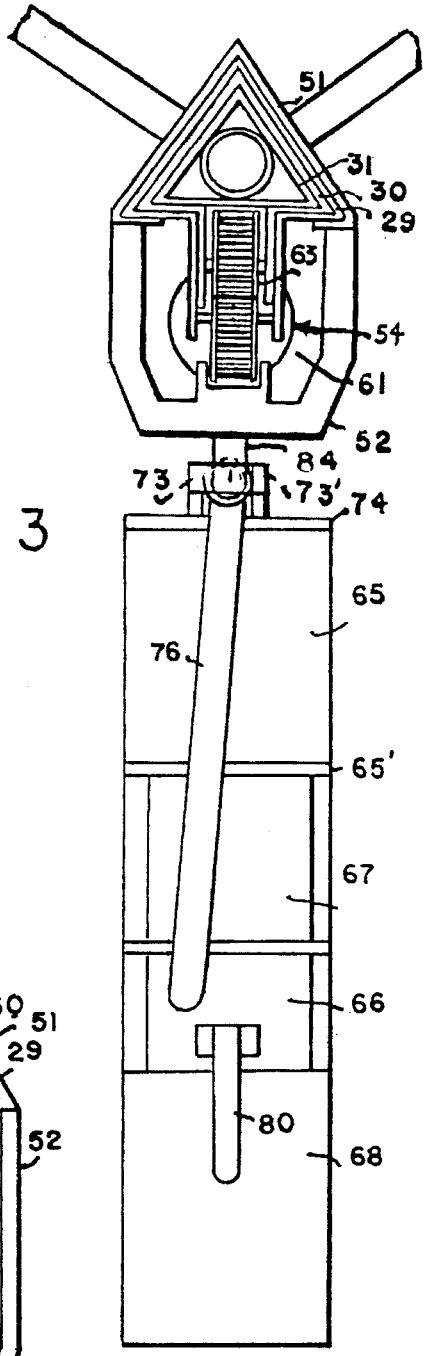
FIG. 3 is a top view of the invention of FIG. 1.
Figure 12:
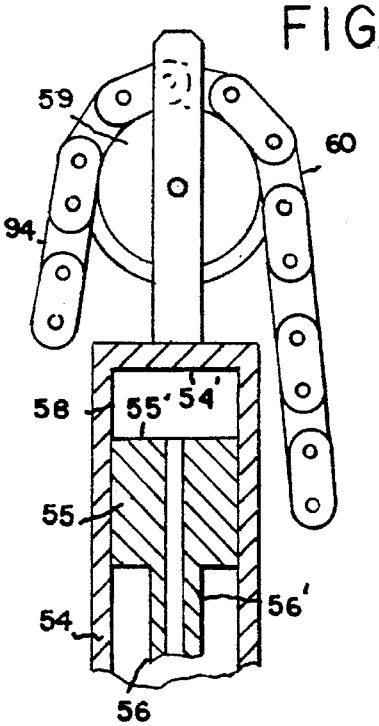
FIG. 12 is a fragmentary side view of the upper portion of hydraulic cylinder and chain.
Figure 13:
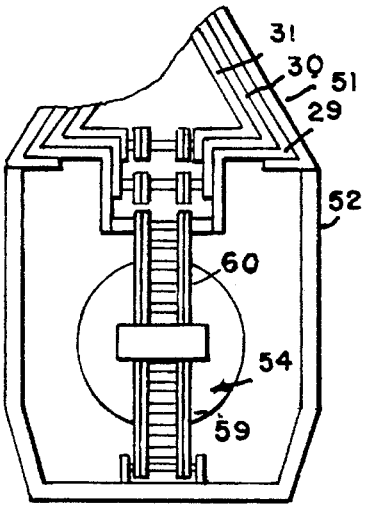
FIG. 13 is a top cutaway view showing the cylinder and its chain.
Figure 5:
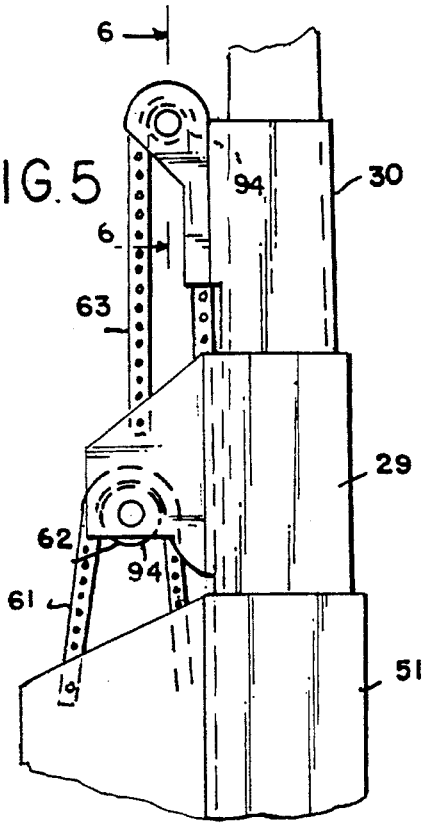
FIG. 5 is a fragmentary side view of the chain and roller drive of the telescoping sections.
Figure 6:
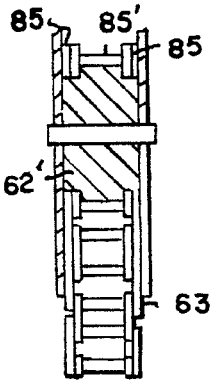
FIG. 6 is a cross sectional view of one of the rollers of the telescoping sections, taken along line 6—6 of FIG. 5.
Figure 7:
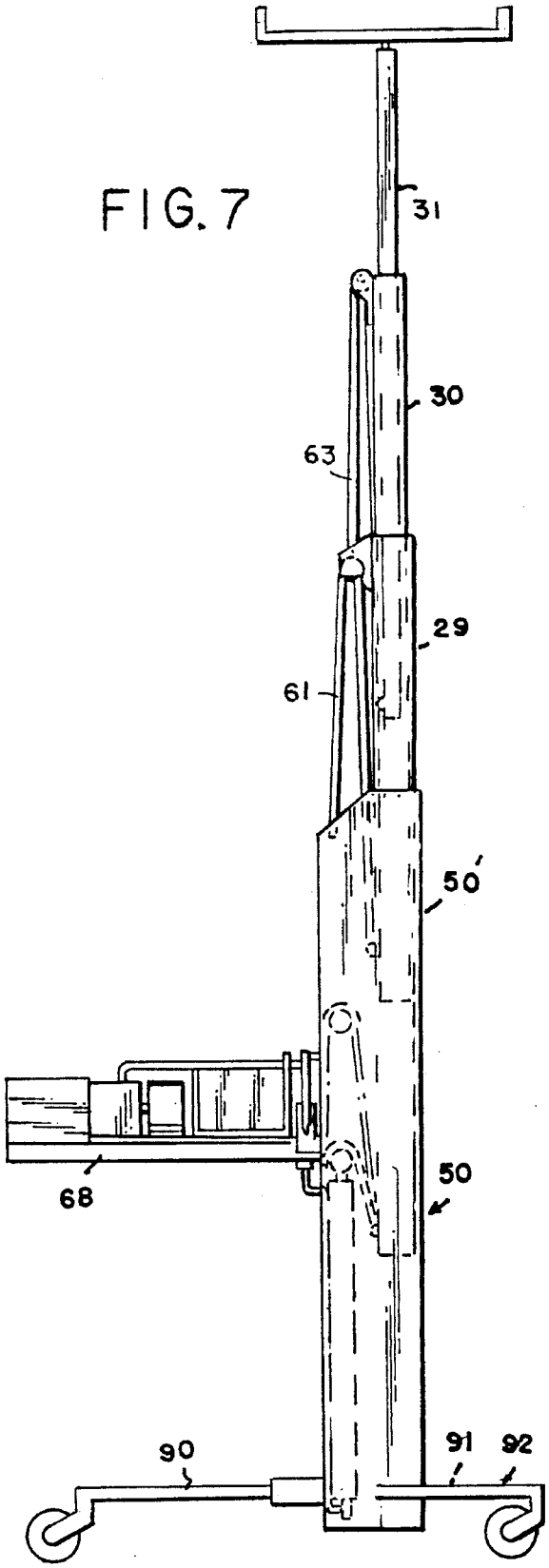
FIG. 7 is a side elevational view of the lifting apparatus, shown after the telescoping sections have telescoped upward a distance.
Figure 8:
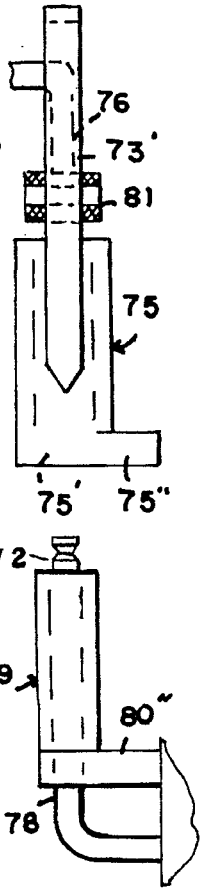
FIG. 8 is an enlarged side fragmentary view of the platform and hose connection to the housing and cylinder in the housing of the apparatus, before the attachment of the platform and hose coupling on the platform to the housing and hose coupling on the housing.
Figure 9:
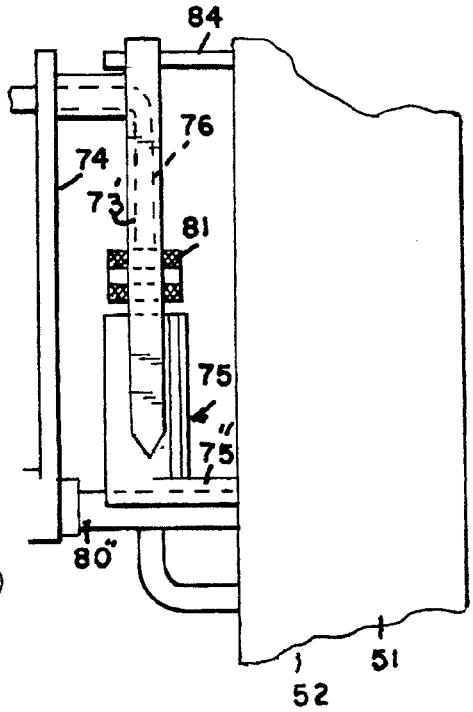
FIG. 9 is an enlarged side fragmentary view of the platform sleeve connection to the rod of the housing and the upper hose coupling on the platform to the hose coupling on the rod of the housing, after the platform sleeve has been mounted to the housing, and the upper hose coupling, mounted in the sleeve, has been attached to the lower hose coupling, mounted in the rod of the housing.
Figure 10:
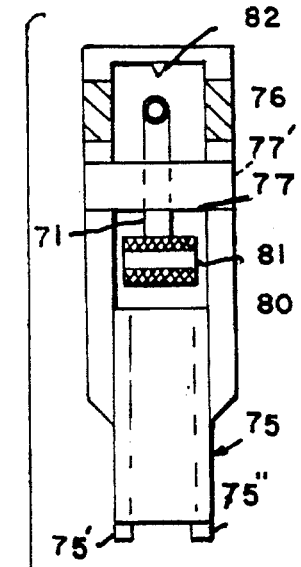
FIG. 10 is an enlarged rear view, similar to FIG. 8, before the platform sleeve and its upper hose couplign have been attached to the rod of the housing and its lower hose coupling.
Figure 11:
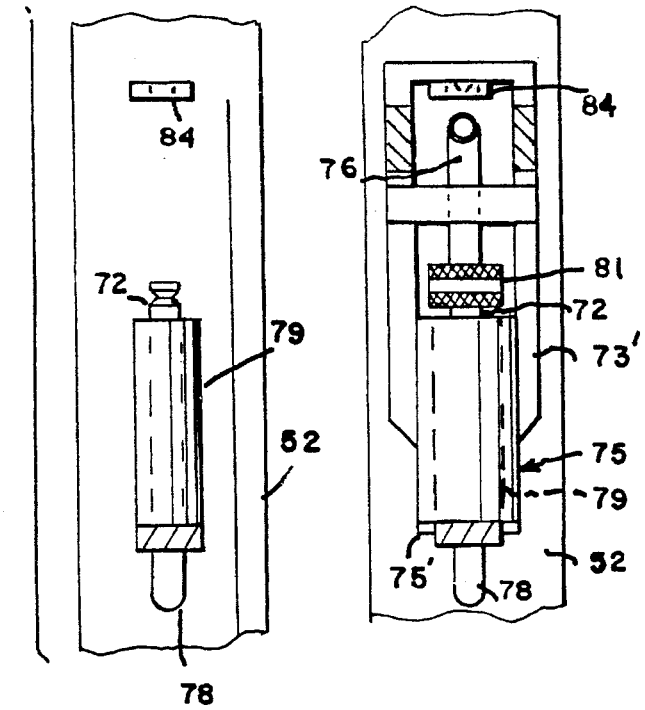
FIG. 11 is an enlarged rear view, similar to FIG. 9, after the platform and housing and the upper and lower hose couplings have coupled together.

Referring more particularly to the drawings, in FIG. 1, the chain driven hydraulic actuated battery powered lift apparatus 20 is illustrated having a housing 21 with a forward fixed sleeve 22 and with three telescoping sleeves 23,24, and 25, telescopingly mounted in the forward fixed sleeve 22 of the housing. A hydraulic cylinder 26 is mounted in the rear compartment 21' of the housing.

In FIGS. 1 through 13, the hydraulic cylinder driven chain drive lifting apparatus 50 is illustrated having a main housing 50'. Three telescoping sleeves 29,30, and 31 in the forward sleeve portion 51 of the housing 50'. Another sleeve or compartment portion is fixed to the rear of the portion of the housing to form the fixed housing; and the housing extends vertically upward and is supported on horizontal legs. A hydraulic cylinder drive 54 is mounted in the rear compartment sleeve of the housing and has a hydraulic cylinder 55 and a piston 56 with the cylinder slidably mounted on the piston 56.

The piston 56 of the cylinder is fixed to the bottom of the rear compartment 53 of the housing. The piston 56 has a hollow piston rod 57 with a port 58 at the bottom of the piston rod to receive hydraulic fluid into the hollow passageway 57' upward through the rod and through a passageway 56'; in the piston 56 into the hollow interior space 58 between the top 59 of the piston and the bottom 55' of the cylinder 55. The cylinder 55 is slidably mounted in the rear of the housing to upward and downward in the housing relative to the piston and housing.

The hydraulic fluid pumped into the upper cylinder interior space forces the cylinder 55 upward in the housing. A roller 60 is rotatably mounted on the top of the upward and downward moving cylinder. A link chain 62 has one end 62' fixed to one edge of the rear sleeve of the housing below the roller 60. The chain 62 extends over the top of the roller 60, then downward on the other side of the roller, with its other lower end 62" attached to the bottom of the outermost tele-sleeve 29 of the three telescoping sleeves 29, 30, and 31.

The chain 62, by extending upward over the top of the roller 60 and then downward to its connections with the sleeve 29 at the bottom of the sleeve rolls with the roller as the cylinder moves upward. This chain arrangement enables the upward movement of the cylinder 55 to move the lower end 62" of the chain 62 upward, twice the distance of the cylinder travel to move the sleeve 29 twice the cylinder travel length.

The hydraulic fluid, in traveling upward through the center of the hollow piston rod, through the piston to the hollow interior space between the top of the piston and the bottom wall of the cylinder adds fluid to this interior space and forces the movable cylinder 55 upward relative to the piston to increase the space to accomodate the added fluid being pumped into the interior space.

A detachable platform 64 is detachably mounted in a horizontal position to the vertical fixed rear sleeve or compartment 53 of the housing. A battery 65 is mounted to the platform, mounted in a U shaped metal plate 65', which houses the battery and is mounted to the platform. A pump 66, an electric motor 67, and a reservior 68 for holding the hydraulic fluid are also mounted on the platform 64. A hose line coupling member 70 has an upper coupling member 71 and a lower coupling member 72 which couple together in detachable relation. The upper coupling member 71 is permanently attached to the front 64' of the platform on a bracket 74 fixed to the platform. The bracket 74 has a pair of side legs 73 and 73' fixed together at their upper end with a sleeve 75 fixed to the lower ends of the legs, just below the upper coupling member.

A hose line 76 is attached at its one end 76' to the upper coupling member 71, and is held to the spaced arms 77 and 77' of the platform by a pair of horizontal braces fixed to the arms by a pair of screws threading the two braces together, through bores in the spaced arms tightening against the hose line 76 from opposite sides and tightening the arms to hold the hose line to the arms of the platform. The hose line 76 at its other end 76" is attached to the output port of the pump 66.

A second hose line 78 has its one end 78' attached to the lower coupling member 72 and extends through a hollow rod 79 fixed to the rear sleeve of the housing 50' with its other end 79" attached to the inlet port 58 into the piston. The rod 79, fixed to the sleeve of the housing, slidably receives the larger sleeve 75 in telescoping relation The larger sleeve 75, being fixed to the platform thereby mounts the platform to the housing. The sleeve 75 also has a pair of side flanges 75' and 75" which extend down on each side of the mounting lug 80" which is directly fixed to the rear sleeve 53 of the housing at one end and fixed to the rod 79 at its other end. The flanges prevent the platform from pivoting about the rod on the sleeve 75 by engaging sides of the mounting lug 80". The mounting lug also serves to space the rod 79 slightly rearward from the housing.

The electric motor 67 has its output shaft connected to the pump 66 so that activation of the motor powers the pump 66. The motor 67 is powered by the storage battery 65 also on the detachable platform.

A control handle 80 is mounted on the pump and has three positions. The handle is spring loaded to its neutral position, in which position the electric motor is turned off. Pivoting the handle upward turns the electric motor on which begins to pump fluid into the cylinder and causes the cylinder to telescope upward. Turning the handle downward opens the line with the motor off allowing fluid to drain out of the cylinder at a rate depending upon how far the handle is pivoted down.

The upper coupling member 71 has an axially slidable ring which is spring loaded downward, but when manually slid axially upward unlatches the upper coupling member from the lower coupling member. This action also unlatches the platform from the housing, as the coupling connection also serves as a platform latch. When the ring 81 is slid downward onto the lower coupling member, the ring automatically slides over the annular ridge 81' on the lower coupling member and locks in the ridge. The upper coupling member has a plurality of balls in a circle under spring pressure radially inward and which lock in the ridge once the coupling has been made.

The upward sliding of the ring member 81 unlatches upper coupling member from the lower coupling member, thereby unlatching the fluid communication between the upper hose line 76 and the lower hose line 78.

The platform and housing, in addition to their sleeve and rod connection, are also connected by a hook or downward pin 82 fixed on an upper brace 83 fixed to the platform. The brace 83 slides over the plate 84 fixed to the housing and the pin slides into a bore in the plate to lock the upper portion of the platform to the housing.

Since the upward movement of ring member uncouples the coupling member and also frees the platform from the locked connection with the housing; the platform may also slide upward by sliding its sleeve 75 upward off the rod 79 of the housing. Simultaneously, the hook 82 will be slid out of the notch of the plate 84 of the housing and off the plate 84 thereby completely, freeing and detaching the platform and its components from the housing. The coupling members upper and lower are of a conventional type coupling well known in the hydraulic art, wherein the coupling members when brought together co-axially will automatically latch together in watertight relation so that fluid may pass through the upper and lower coupling members.

While the telescoping sleeve 29 is slid upward by the chain 62 being drawn up at one end, sleeve 29 has a roller rotatably mounted at its top and a chain 61 has one end attached to the housing and extends over this roller and its other end 61" is attached to the lower end of sleeve 30, and sleeve 30 has a roller rotatably mounted to its top and a chain 63 attached to sleeve 30 at its one end and extends over the roller with its other end 63" attached to the lower end of sleeve 31. Consequently, when sleeve 29 is telescoped upward by the upward movement of the cylinder, the roller on sleeve 29 moves upward drawing the other end of chain 61 upward twice the length of travel of sleeve 29, thereby telescoping the sleeve 30 upward, and the upward movement of sleeve 30 moves its roller upward, engaging against the chain 63 and drawing the other end of chain 63 upward thereby drawing the sleeve 31 upward twice the length of travel of sleeve 30 thereby telescoping sleeve 31 upward relative to sleeves 29 and 30.

The rollers 59, 62, and 62' all have opposing annular reduced shoulders 94 about their opposite faces to receive the pivoting edges of the edge plates 85 of the chains 61 and 63, so that the edge plates 85 will rest and ride in the reduced shoulder while the lateral pins 85' extending across from one edge plate to the other edge plate will rest on the outer circumference of the rollers. The chains roll around with the rollers as their other ends are brought up by the upward movement of the rollers against the chains, as the chains raise the three telescoping sections 29,30, and 31 by the action of cylinder drive 54. The shoulders act to keep the chains aligned on the roller.

Operation:

The chain drive lifting apparatus 50 will operate as follows:

The three horizontal legs 90,91, and 92 extend horizontally outward from the housing at even intervals about the housing and will have rollers mounted at their outer ends for rolling the apparatus to different locations for raising panels on the apparatus.

A dry wall panel, not shown, or other object to be raised will be placed on the horizontal frame 94' mounted to the top of the innermost sleeve 31. The operator will raise the handle 80 to activate the electric motor which starts the pump which pumps hydraulic fluid from the reservoir 68 through the pump along hose line 76 through the upper and lower coupling members, while coupled together to the inlet port 58 of the piston upward through the piston into the space 58 causing the cylinder 55 to telescope upward thereby telescopes sleeves 29,30, and 31 upward. The sections will telescope upward to their limit unless the handle 80 is turned down to neutral stopping the flow of fluid into the cylinder.

When the sections or sleeves 29,30, and 31 have been telescoped to their desired height the drywall panel was to be raised, the handle will be pivoted down to its neutral position which turns the electric motor off. Since this keeps the valve closed to return flow of the fluid, the fluid cannot flow back into the reservoir and the telescoped sections remain held in their telescoped position while the drywall panel is installed.

When the drywall panel has been installed and it is desired to retract the sleeves or sections 29,30, and 31 back down into the housing the handle will be pivoted down below neutral which gradually opens the drain valve allowing fluid to drain back from the cylinder back into the reservior. The drain valve has graduated construction so that the amount of draining of the fluid back into the reservoir may be relatively small if desired and its rate of flow back gradually increased if desired. The weight of the telescoping sections will act to force the cylinder downward to thereby cause the return flow of fluid back into the reservoir.

Thus, it will be seen that a novel battery operated, hydraulic cylinder powered, chain driven telescoping panel lifting apparatus has been provided which can quickly telescope the lifting sections of the device to telescope a drywall panel and the like quickly upward for installation. Further, it will be seen that the sections may be quickly lowered under gravity by the release of the hydraulic holding action of the cylinder upon the telescoping sections, so that they may quickly, under gravity, retract back down to their retracted position.

It will be obvious that various changes and departures may be made to the invention without departing from the spirit and scope thereof, and accordingly, it is not intended that the invention be limited to that specifically described in the specification or as illustrated in the drawings, but only as set forth in the appended claims herein.

What is claimed is:

1. A lifting apparatus comprising a housing, at least three elongated telescoping members extending upward in said housing and slidably mounted in telescoping relation to one another, three elongated chains, power actuated upward extending drive means, three roller means with one of said roller means mounted to the top of said power actuated upward extendable drive means, a second of said roller means mounted to the top of a first one of said three telescoping members, a third one of said roller means mounted to the top of a second one of said three telescoping members, each of said chains having opposite ends below their respective roller means, said first of said chains having its one end attached to said housing and its other end attached to the lower end of a first one of said telescoping members, a second of said chains having one of its ends attached adjacent the top of said first telescoping members and its other end attached to the lower end of a second of said three telescoping members a third of said chains having its one end attached adjacent the top of said second telescoping member and its other end attached to the lower end of said third telescoping member, whereby actuation of said upward extendable drive means causes said one roller on top thereof to engage and raise said first chain intermediate its ends with one of its ends held from rising causing the other of its ends and the first telescoping member by its lower end to raise upward in reaction thereto with the raising of the first telescoping member causing the second roller on top thereof to engage and raise the second chain intermediate its ends thereby raising the other end of the second chain and sliding upward the second telescoping member by its lower end with respect to the first telescoping member, with the raising of the second telescoping member causing the third roller on the top thereof to engage the third chain intermediate its ends thereby raising the other end of the third chain and the third telescoping member by its lower end relative to the first and second telescoping member, said apparatus including a detachable platform having a detachable connection with said housing, said platform having a reservoir for holding fluid, a fluid pump, an electric motor with a battery for powering said motor, said power actuated upward extending drive means comprising a fluid actuated piston and cylinder on said housing, a fluid connection between said reservoir and said pump and a hose connection between said pump on said platform and said fluid cylinder said housing, said hose connection having a detachable connection between said pump and cylinder.

2. A lifting apparatus according to claim 1, wherein said detachable hose connection is adjacent said detachable platform connection.

3. A lifting apparatus according to claim 2, wherein said detachable hose connection is coaxial with said detachable platform connection and said detachable hose connection includes locking means which also serves as locking means for locking said platform to said housing.

4. A lifting apparatus according to claim 1, wherein said detachable hose connection also includes locking means for locking said hose connection together, and said locking means also serves as locking means for locking said platform to said housing.

5. A lifting apparatus comprising a vertical extending housing, at least three vertical telescoping members extending upward in said housing and slidable in telescoping relation to one another and to said housing, actuated drive means on said housing and acting to drive said telescoping members whereby actuation of said drive means in one direction acts to telescope said telescoping members upward in said housing and actuation of said drive means in the opposite direction acts to retract said telescoping members into said housing, said apparatus including a detachable platform having opposing ends with one of said ends detachably connected to said vertical housing intermediate the height of said housing, said detachable platform having an electric battery and means responsive to said battery acting to transmit power to said drive means on said housing, a first elongated connecting means having opposing ends with one end connected to said drive means, a second connecting means having opposing ends with one of said ends detachably connected to the other end of said first connecting means and its other end connected to said means responsive to said battery whereby said battery may power said means to transmit power and said means to transmit power may transmit power along said second and first connecting means to said drive means on said housing, whereby said drive means may telescope and retract said telescoping members relative to one another and to said housing, said first and second connecting means having said detachable connection to one another whereby said first and second connecting means may be detached from one another when said platform is detached from said housing.

6. A lifting apparatus according to claim 5, wherein said drive means is fluid actuated.

7. A lifting apparatus according to claim 6, wherein said platform extends horizontally.

8. A lifting apparatus according to claim 6 wherein said fluid actuated drive means comprises a fluid actuated piston and cylinder, with said cylinder telescoping upward relative to said piston upon actuation.

9. A lifting apparatus comprising a vertical extending housing;

a plurality of vertical telescoping members extending upward in said housing and slidable in telescoping relation to one another and to said housing, fluid actuated drive means on said housing and acting to drive said telescoping members whereby actuation of said drive means in one direction acts to telescope said telescoping members upward in one direction and actuation of said drive means in the opposite direction acts to retract said telescoping members into said housing, said apparatus including a detachable platform having opposing ends with one of said ends detachably connected to said housing, said detachable platform having a fluid pump, a fluid reservior for providing fluid for said pump, and means to power said pump with said pump acting to transmit power to said drive means on said housing, a first elongated connecting means having opposing ends with one of said ends connected to said drive means, a second connecting means having opposing ends with one of said ends detachably connected to said other end of said first connecting means and its other end connected to said pump, means to power said pump whereby said means to power said pump may power said pump to transmit fluid from said reservoir along said second and first connecting means to said fluid drive means on said housing, whereby said fluid drive mean may telescope and retract said telescoping members relative to one another and to said housing, said first and second connecting means having said detachable connection to one another whereby said first and second connecting means may be detached from one another when said platform is detached from said housing.

10. A lifting apparatus according to claim 9, wherein said plurality of telescoping members comprises at least three telescoping members.

11. A lifting apparatus according to claim 10, wherein said means to power said pump comprises a battery and an electric motor with said battery powering said electric and said motor powering said pump.

* * * * *